US009457577B2

(12) United States Patent
Akuta

(10) Patent No.: US 9,457,577 B2
(45) Date of Patent: Oct. 4, 2016

(54) INK JET RECORDING DEVICE WITH INKJET HEAD CLEANING MEMBER

(71) Applicant: MIMAKI ENGINEERING CO., LTD., Nagano (JP)

(72) Inventor: Shunsuke Akuta, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/438,635

(22) PCT Filed: Oct. 30, 2013

(86) PCT No.: PCT/JP2013/079339

§ 371 (c)(1),
(2) Date: Apr. 27, 2015

(87) PCT Pub. No.: WO2014/069494

PCT Pub. Date: May 8, 2014

(65) Prior Publication Data

US 2015/0273836 A1 Oct. 1, 2015

(30) Foreign Application Priority Data

Oct. 31, 2012 (JP) ..... 2012-239804

(51) Int. Cl.
*B41J 2/165* (2006.01)

(52) U.S. Cl.
CPC ..... *B41J 2/16535* (2013.01); *B41J 2/16538* (2013.01); *B41J 2/16541* (2013.01); *B41J 2/16552* (2013.01); *B41J 2002/16558* (2013.01)

(58) Field of Classification Search
CPC .. B41J 2/165; B41J 2/16517; B41J 2/16505; B41J 2/16535; B41J 2/16552; B41J 2/16538; B41J 2/16541; B41J 2/1707; B41J 2/1714
See application file for complete search history.

(56) References Cited

U.S. PATENT DOCUMENTS 5,907,335 A * 5/1999 Johnson et al. ..... B41J 2/16538 347/28
8,226,205 B2 * 7/2012 Izawa et al. ..... B41J 2/16547 347/33

FOREIGN PATENT DOCUMENTS

| | | |
|---|---|---|
| JP | 2000-980 | 1/2000 |
| JP | 2001-191543 | 7/2001 |
| JP | 2005-014560 | 1/2005 |
| JP | 2007-185795 | 7/2007 |

OTHER PUBLICATIONS

"International Search Report (Form PCT/ISA/210)", mailed on Dec. 17, 2013, with English translation thereof, pp. 1-3, in which three of the listed references (JP2000-980, JP2007-185795 and JP2001-191543) were cited.
"1st Office Action of China Counterpart Application", with English translation thereof, issued on Oct. 28, 2015, P1-P14.

* cited by examiner

*Primary Examiner* — Juanita D Jackson
(74) *Attorney, Agent, or Firm* — Jianq Chyun IP Office

(57) ABSTRACT

It is an object of the invention to provide an inkjet recording device that can clean a blade of a wiper to which ink had adhered, whereby nozzle clogging in an inkjet head and ink color mixing are prevented to enable recording with high image quality. As a solution, an inkjet recording device (1) according to the present invention includes a wiping unit (30) that wipes off ink by sliding a blade (34) on a nozzle surface (24) of an inkjet head (20); and a cleaning unit (40) that performs cleaning by pouring cleaning liquid on the blade (34).

16 Claims, 4 Drawing Sheets

INK JET RECORDING DEVICE WITH INKJET HEAD CLEANING MEMBER

CROSS-REFERENCE TO RELATED APPLICATION

This application is a 371 application of the International PCT application serial no. PCT/JP2013/079339, filed on Oct. 30, 2013, which claims the priority benefit of Japan Patent Application no. 2012-239804, filed on Oct. 31, 2012. The entirety of each of the above-mentioned patent applications is hereby incorporated by reference herein and made a part of this specification.

TECHNICAL FIELD

The present invention relates to an inkjet recording device, and more specifically to an inkjet recording device that performs a recording by discharging liquid onto a medium from an inkjet head mounted on a carriage which scans over the medium.

BACKGROUND ART

Various configurations have been known conventionally of inkjet recording devices (inkjet printers) that discharge ink from a nozzle of an inkjet head to record (print) desired letters and shapes on a recording medium.

Generally, in an inkjet recording device, when a printing process is performed, discharged ink may gradually adhere to a nozzle surface of an inkjet head, and further, an ink droplet may be formed by the adherent ink merging with each other. Moreover, such an ink droplet gradually hardens, and in some cases may become viscous ink, for example in a gel form. As above, if printing is performed continuously in a state where the viscous ink, the ink droplet and the like are adherent to the nozzle surface, a problem of print quality degrading may occur by the ink droplet dripping onto the recording medium, or by causing nozzle clogging. Thus, conventionally, a technique that performs cleaning by wiping the nozzle surface of the inkjet head by a blade and the like formed of rubber material and the like has been known (for example, see Patent Document 1).

PRIOR ART DOCUMENT

Patent Document

Patent Document 1: JP 2005-014560 A

SUMMARY OF THE INVENTION

Problem to be Solved by the Invention

However, in a configuration exemplified in Patent Document 1, a state is assumed in which ink is adherent to a blade of a wiper by performing wiping. Thus, there has been a problem that, if wiping is continued in such a state, the ink adherent to the blade may enter a nozzle to cause clogging or ink color mixing.

The present invention has been made in view of the above problem, and an object thereof is to provide an inkjet recording device that can clean a blade of a wiper to which ink is adherent, whereby nozzle clogging in an inkjet head and ink color mixing therein are prevented to enable recording with high image quality.

Solutions to the Problem

As one embodiment, the problem may be solved by a solution as disclosed below.

An inkjet recording device disclosed herein is characteristic in including a wiping unit that wipes off ink by sliding a blade on a nozzle surface of an inkjet head; and a cleaning unit that performs cleaning by pouring cleaning liquid on the blade.

Further, an inkjet recording device disclosed herein is characteristic in being an inkjet recording device in which liquid is supplied to an inkjet head mounted on a carriage that moves reciprocatingly in a main scanning direction and the liquid is discharged from a nozzle of the inkjet head onto an opposing recording medium while the carriage is moving reciprocatingly in the main scanning direction, and the inkjet recording device including: a wiping unit including a blade that wipes off ink on a nozzle surface of the inkjet head by sliding its distal end portion on the nozzle surface from a lower side; and a cleaning unit including an outflow portion that allows cleaning liquid to flow out to a distal end portion side of the blade.

According to the inkjet recording device disclosed herein, since the nozzle surface of the inkjet head can be wiped by the blade of the wiping unit, the ink adherent to the nozzle surface can be removed. Moreover, the blade that has performed wiping can be cleaned by the cleaning unit, and the ink adherent to the blade can be removed; thus, the nozzle clogging and ink color mixing in the inkjet head can be prevented even in cases where wiping is performed continuously.

Further, in the present invention, the cleaning unit is preferably arranged at one end portion in the main scanning direction, at a standby position for the inkjet head to stand by.

Further, in the present invention, the cleaning unit preferably allows the cleaning liquid to flow out to the distal end portion side of the blade in a state where the inkjet head has moved to the standby position.

According to this, wiping of the nozzle surface and cleaning of the blade of the wiping unit can be performed by using the standby time of the inkjet head. Further, in view of a risk that an undesirable influence may occur in a printing process if wiping and cleaning are performed during the printing process, such an undesirable influence can be prevented.

Further, in the present invention, preferably the inkjet recording device further includes a storage portion that stores the cleaning liquid; a flowing member having one end joined to the storage portion, including the outflow portion at the other end, and configured to allow the cleaning liquid to flow through an inside thereof; and a controlling member that controls an outflow of the cleaning liquid from the outflow portion and stoppage thereof. According to this, the cleaning liquid can be supplied from the storage portion provided in the inkjet recording device to perform cleaning of the blade of the wiping unit.

Further, in the present invention, the cleaning unit preferably includes a cleaning liquid guiding member between a distal end portion of the blade and the outflow portion, the cleaning liquid guiding member configured to expand a pouring region of the cleaning liquid and perform positioning of a pouring position. According to this, it becomes possible to pour the cleaning liquid over a wider region in a longitudinal direction of the blade with respect to a plate surface of the laterally elongate blade. Moreover, a pouring position, that is, a position where the cleaning liquid flows down can be set easily and highly accurately.

Further, in the present invention, preferably the cleaning liquid guiding member has its distal end portion opposed to the distal end portion of the blade with respect to the blade at a predetermined position, and is arranged at a position that splits a flow of the cleaning liquid to both front and back surface sides of the blade. According to this, pouring can be performed on both front and back surfaces of the blade just by discharging the cleaning liquid, and the adherent ink can be washed off. Thus, a complicated mechanism for changing a discharging direction of the cleaning liquid to both surface sides of the blade does not need to be provided, whereby a device configuration can be simplified, and device cost reduction can be achieved.

Further, in the present invention, preferably the cleaning liquid guiding member includes a straight portion of which distal end portion is formed straight, the blade includes a straight portion of which distal end portion is formed straight, the straight portion of the cleaning liquid guiding member and the straight portion of the blade are arranged to be opposed and parallel to each other, and the cleaning liquid guiding member has its distal end portion formed with a width by which the cleaning liquid flowed out from the outflow portion spreads over substantially an entire region in a width direction of the blade.

Further, in the present invention, preferably the cleaning liquid guiding member includes a straight portion of which distal end portion is formed straight, the blade includes a straight portion of which distal end portion is formed straight, the straight portion of the cleaning liquid guiding member and the straight portion of the blade are arranged to be opposed and parallel to each other, and the distal end portions of the cleaning liquid guiding member and the blade are arranged at an interval by which the cleaning liquid flowed out from the outflow portion spreads over substantially an entire region in a width direction of the blade.

According to these, since it becomes possible to pour the cleaning liquid over substantially the entire region in the width direction (longitudinal direction) of the blade, an ink removal effect can be increased.

Further, in the present invention, the cleaning liquid guiding member is preferably supported by a supporting member by which the wiping unit is supported. According to this, by the cleaning liquid guiding member and the wiping unit (especially the blade) being supported by the same supporting member, positional accuracy of arrangements of both the cleaning liquid guiding member and the blade can be improved.

Further, in the present invention, the wiping unit preferably includes step portions on both surface sides of the blade at positions that are lower than a distal end portion of the blade by a predetermined length. According to this, the cleaning liquid that has been poured onto the blade flows in left and right directions on the step portions and reaches the wider region in the longitudinal direction, whereby an effect that the surface of the blade is cleaned over a wide region can be achieved. Moreover, since flows of the cleaning liquid from a center toward both the left direction and the right direction are generated, the cleaning effect can further be increased.

EFFECTS OF THE INVENTION

According to the inkjet recording device disclosed herein, the wiping unit and the cleaning unit are provided to clean the blade of the wiper to which the ink has adhered, whereby nozzle clogging in the inkjet head and ink color mixing therein can be prevented, and recording with high image quality becomes possible.

DESCRIPTION OF THE EMBODIMENTS

Hereinbelow, embodiments of the present invention will be described in detail with reference to the drawings.

Figure 1:
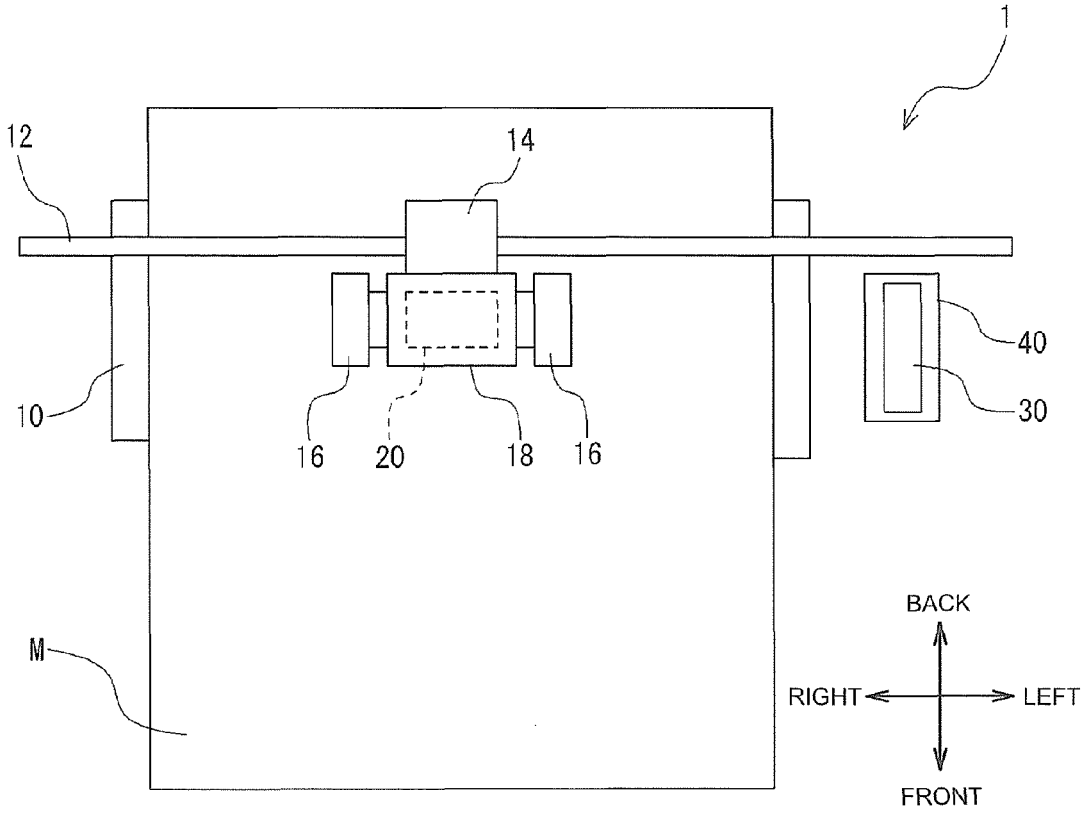
FIG. 1 is a schematic diagram (plan diagram) showing an example of an inkjet recording device according to an embodiment of the present invention.
Figure 2:
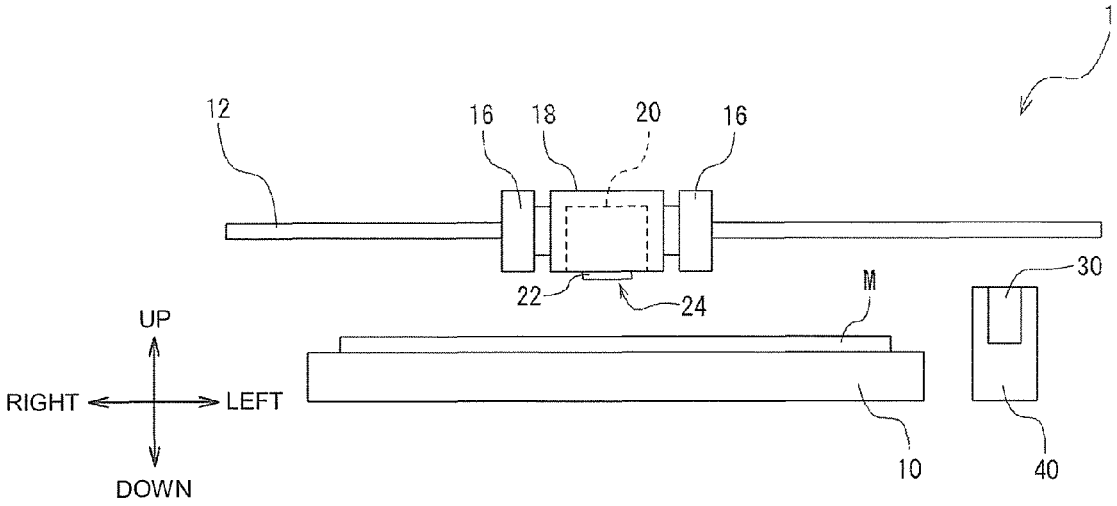
FIG. 2 is a schematic diagram (lateral side diagram) of the inkjet recording device shown in FIG. 1.

FIG. 1 shows a schematic diagram (plan diagram) of an inkjet recording device 1 according to this embodiment. Further, FIG. 2 shows a schematic diagram (lateral side diagram) of the inkjet recording device 1. For the sake of convenience of description, in respective diagrams, front and back, left and right, and up and down directions of the inkjet recording device 1 are shown by arrow directions.

It should be noted that, in all of the drawings for explaining the embodiments, members with an identical function are given the same reference sign, and repeating description thereof may in some cases be omitted.

The inkjet recording device 1 is a device that performs a printing process for letters, figures, and the like on a recording surface (print surface) of a recording medium M such as paper, cloth, and resin sheet (for example, formed of vinyl chloride, polyester, and the like) by discharging liquid (which is herein ink) from a nozzle of an inkjet head.

The inkjet recording device 1 according to the present embodiment has a Y bar 12 bridged above a platen 10 on which the recording medium M is to be mounted, in a direction (left and right direction in FIG. 1) that intersects orthogonally with a transfer direction of the recording medium M (forward direction in FIG. 1), and a carriage 14 is movably retained on this Y bar 12. Due to this, the carriage 14 is configured to be movable in the left and right direction by being guided by the Y bar 12. It should be noted that the carriage 14 is joined to a traction mechanism using a wire, a ball, and the like, and is configured to be capable of moving in the left and right direction by controlling driving of a driving source such as a motor.

This carriage 14 has fixed thereon a head unit 18, on which an inkjet head 20 configured to discharge ink droplets is mounted.

Figure 5:
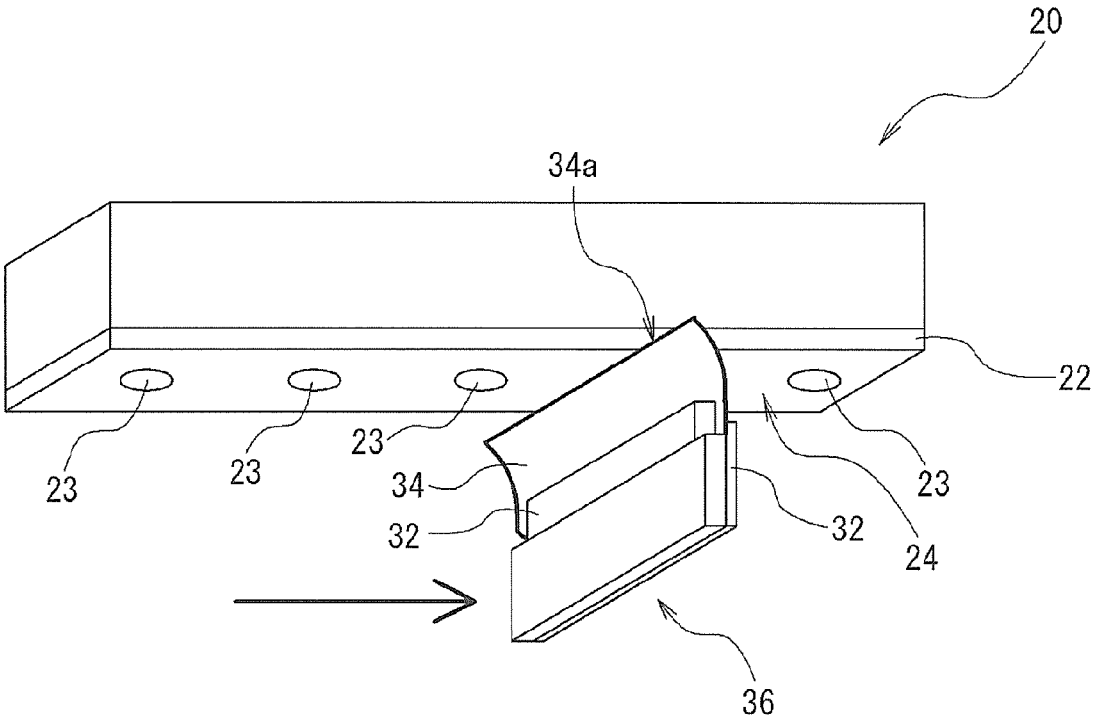
FIG. 5 is a schematic diagram for explaining a sliding operation of the wiper shown in FIG. 4A to FIG. 4C.

The inkjet head 20 is provided with a nozzle plate 22 on which a plurality of nozzles 23 configured to discharge ink droplets is formed (see FIG. 2 and FIG. 5). Further, a nozzle surface 24 from where ink droplets are discharged is formed on a surface of the nozzle plate 22 on a side of the platen 10 and the recording medium M. It should be noted that a type of the ink is not particularly limited and ink for inkjet printing such as UV ink and latex ink may be used.

Here, in the present embodiment, a case of using the UV ink that cures by UV (ultraviolet ray) irradiation will be exemplified. Thus, the head unit 18 has UV irradiators 16 that deliver UV fixed on both sides in the left and right direction. It should be noted that, in case of using ink other than the UV ink (for example, latex ink and the like), the UV irradiators 16 may not be provided in the configuration.

By the above configuration, the head unit 18 and the UV irradiators 16 can be moved simultaneously in the left and right direction by moving the carriage 14 in the left and right direction. Moreover, while moving the carriage 14 in the left and right direction, the ink droplets are discharged from the head unit 18 and the UV is delivered from the UV irradiators 16 so that the discharge of ink droplets and the curing of the ink droplets that has struck onto the recording medium M can be performed in a single scan.

Figure 3:
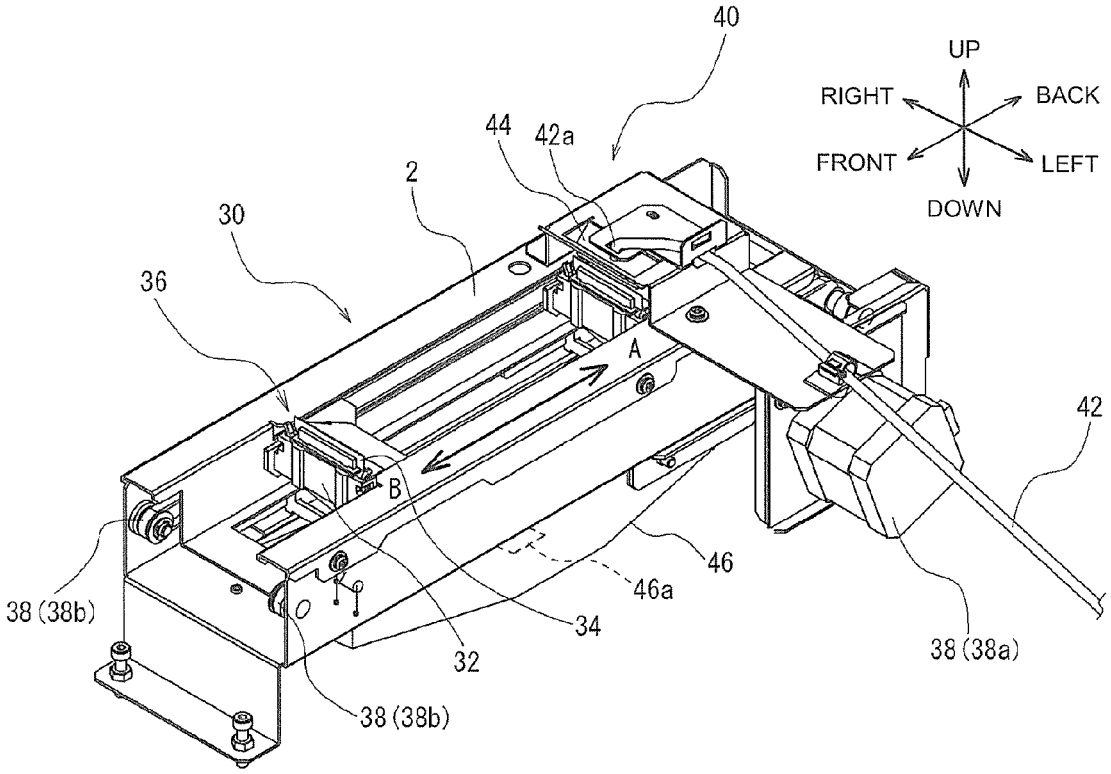
FIG. 3 is a schematic diagram (perspective diagram) showing an example of a wiping unit and a cleaning unit of the inkjet recording device shown in FIG. 1.

Further, in the present embodiment, a wiping unit 30 that wipes the nozzle surface 24 of the inkjet head 20 is provided below the inkjet head 20 when the head unit 18 is moved to an end portion on one side (right side in FIG. 1 and FIG. 2). Here, a configuration example of the wiping unit 30 and a configuration example of a cleaning unit 40 to be described later will be shown in a perspective diagram (schematic diagram) of FIG. 3. It should be noted that, as shown in FIG. 3, the wiping unit 30 (especially a blade 34) and the cleaning unit 40 are supported by the same supporting member (supporting member 2). According to this, a positional accuracy of relative arrangements of both the wiping unit 30 and the cleaning unit 40 can be improved.

In the present embodiment, the wiping unit 30 is preferably arranged at one end portion in a main scanning direction (left and right direction in FIG. 1 and FIG. 2), at a predetermined standby position for the inkjet head 20 to stand by. According to this, wiping of the nozzle surface 24 can be performed by using the standby time between the printing processes of the inkjet head 20. Further, contaminating the recording medium M by unintended ink dripping caused by wiping can be prevented.

Figure 4A:
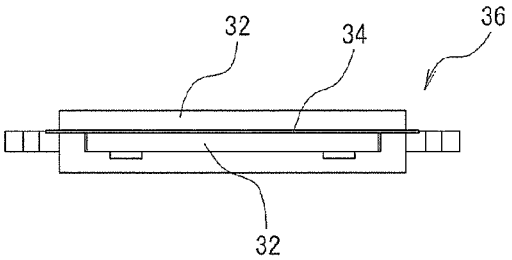
FIG. 4A to FIG. 4C are schematic diagrams (diagrams of three sides) showing an example of a wiper of the wiping unit shown in FIG. 3.
Figure 4B:
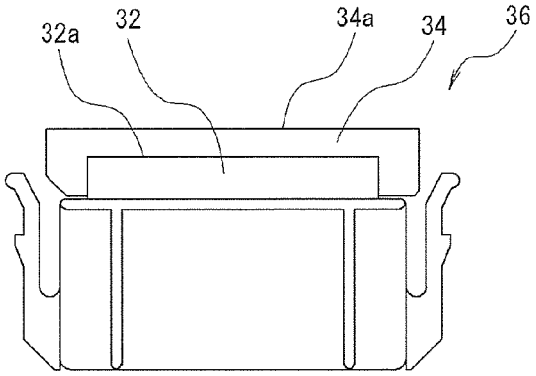
Figure 4C:
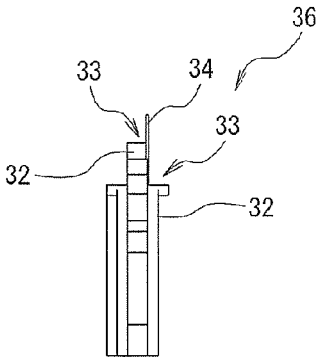

As shown in the perspective diagram (schematic diagram) of FIG. 3, the wiping unit 30 according to the present embodiment is configured by a wiper 36 having a blade 34 sandwiched from both surface sides by a supporting member 32 attached to a moving unit 38 so as to be reciprocatingly movable in a predetermined range (which is herein between A and B in FIG. 3). Here, a configuration example of the wiper 36 is shown in diagrams of three sides (schematic diagrams) of FIG. 4A to FIG. 4C. It should be noted that FIG. 4A is a plan diagram, FIG. 4B is a front diagram, and FIG. 4C is a lateral side diagram.

According to the above configuration, a distal end portion (upper end edge) 34*a* of the blade 34 is brought into contact with the nozzle surface 24 of the inkjet head 20 and the wiper 36 (that is, the blade 34) is moved in a predetermined direction by the moving unit 38 to perform wiping (wipe-off), and the ink adherent to the nozzle surface 24 including distal end portions (opening portions) of the nozzles 23 can be removed (see FIG. 5). It should be noted that, although a specific wiping operation will be described later, one wiping operation on the blade 34 is performed by sliding in one predetermined direction (an arrow direction in FIG. 5).

Here, the blade 34 is preferably formed of a material satisfying characteristics such as having flexibility and strength by which ink removal is mechanically enabled, not damaging a surface of the nozzle surface 24, and having resistance against acidic or alkali cleaning liquid; for example, resin materials such as polypropylene, or rubber materials such as EPDM are used. However, no limitation is made to these materials. As one example, the blade 34 according to the present embodiment is formed in a substantially rectangular flat plate shape by using polypropylene, and is configured such that its distal end portion (upper end edge) 34*a* makes linear contact with the nozzle surface 24.

Further, the wiping unit 30 is configured such that an upper end portion of the supporting member 32 is formed at a lower position in a height direction than the distal end portion (upper end edge) 34*a* of the blade 34, and the upper end portion of the supporting member 32 has an upper surface 32*a* with a predetermined width in the front and back direction as well as the left and right direction. That is, the wiping unit 30 is configured to have step portions 33 protruding in the front and back direction and extending in the left and right direction at positions that are lower than the distal end portion of the blade 34 by a predetermined length on both surface sides of the blade 34 (see FIG. 4A to FIG. 4C). As one example, the supporting member 32 according to the present embodiment is formed in a cuboid by using materials such as EPDM, and as shown in FIG. 5, is configured to support the blade 34 so that the blade can deform (warp). Further, by having the step portions 33, a cleaning operation to be described later can effectively be performed.

Further, the moving unit 38 that moves the wiper 36 is configured by including a timing belt 38*b* that is wound on a drive roller (not shown) that is driven by a drive motor 38*a* and a driven roller (not shown), and is arranged at a position to clean the nozzle surface 24 of the inkjet head 20, for example, a predetermined position in the vicinity of a home position of the carriage 14 for scanning the inkjet head 20, so as to be able to move the wiper 36 while opposing it to the nozzle surface 24 with a certain interval from the nozzle surface 24 of the inkjet head 20.

The drive motor 38*a* is configured for example of a pulse motor, and rotates the timing belt 38*b* forward and backward by switching its phase excitation forward and backward. It should be noted that, a position of the wiper 36 is detected for example by a position detection sensor (not shown).

Next, a cleaning unit 40 characteristic of the present embodiment will be described. The cleaning unit 40 is for cleaning the blade 34 by performing pouring of the cleaning liquid on the wiper 36 (especially, the blade 34) (an operation to pour the cleaning liquid and wash). It should be noted that the cleaning liquid may suitably be selected according to a type of ink to be used, and liquid having an effect of swelling and removing the ink that has increased viscosity and solidified is suitable.

As one example, acidic liquid and the like of about pH 1.5 to 4.0 containing organic carboxylic acid is used.

In the present embodiment, the cleaning unit 40 is preferably arranged at a position where it matches with the wiping unit 30, that is, at one end portion in the horizontal scanning direction (the left and right direction in FIG. 1 and FIG. 2), at the predetermined standby position for the inkjet head 20 to stand by (see FIG. 1 and FIG. 2). According to this, it is possible to perform cleaning of the wiper 36 (blade 34) by using the standby time between the printing processes of the inkjet head 20. Further, contaminating the recording medium M by dripping of the cleaning liquid or the ink can be prevented.

Figure 6A:
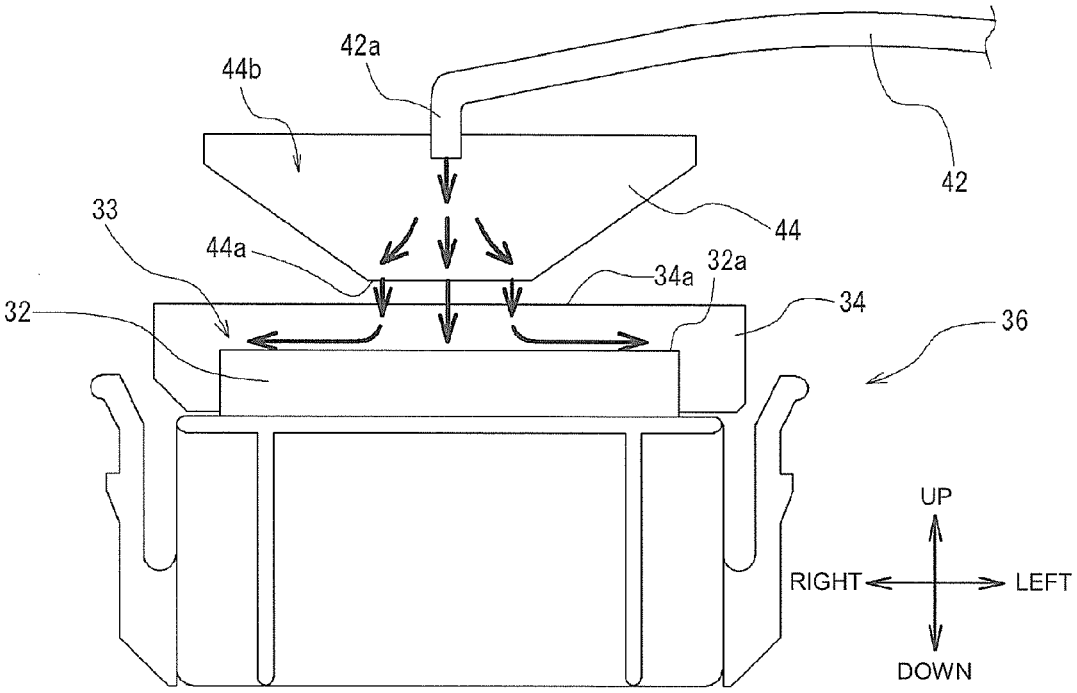
FIG. 6A and FIG. 6B are schematic diagrams for explaining a configuration and a cleaning operation of the cleaning unit shown in FIG. 3.
Figure 6B:
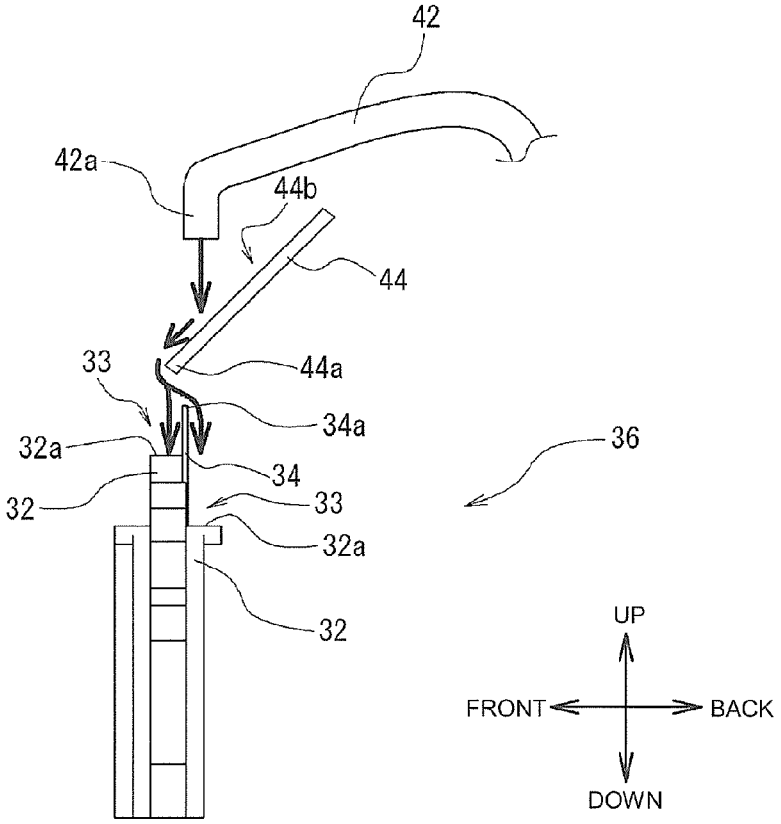

As shown in the perspective diagram (schematic diagram) of FIG. 3, the cleaning unit 40 according to the present embodiment is configured by including a cleaning liquid discharging pipe 42, a cleaning liquid guiding member 44, and a cleaning liquid tray 46. Schematic diagrams for explaining more detailed configuration example and cleaning operation are shown in FIG. 6A and FIG. 6B (where FIG. 6A is a front diagram, and FIG. 6B is a lateral side diagram). The cleaning liquid is stored in a storage portion (not shown), and is fed by liquid feeding unit such as a pump (not shown), passes through the flowing member (cleaning liquid discharging pipe) 42, and is discharged from an outflow portion (discharge port) 42*a* at an end portion of the cleaning liquid discharging pipe 42. Here, the cleaning liquid discharging pipe 42 has the outflow portion (discharge port) 42*a* positioned above the cleaning liquid guiding member 44, and is arranged such that the discharged cleaning liquid flows over the cleaning liquid guiding member 44. Further, a control member (as one example, a pump, a valve and the like) that controls an outflow of the cleaning liquid from the outflow portion (discharge port) 42*a* and stoppage thereof is provided (not shown). It should be noted that, the outflow (discharge) of the cleaning liquid is performed in a state where the inkjet head 20 is moved to the aforementioned standby position.

The cleaning liquid guiding member 44 is a member that expands the pouring region of the cleaning liquid in a lateral direction (left and right direction) of the blade 34 of the wiper 36, and performs accurate positioning of the pouring position. More specifically, as shown in the front diagram (schematic diagram) of FIG. 6A, the cleaning liquid guiding member 44 is configured by having an angled surface 44*b* including a distal end portion (lower end edge) 44*a* with a predetermined width. As one example, the cleaning liquid guiding member 44 according to the present embodiment is formed in a flat plate shape having the inversed-trapezoidal angled surface 44*b*, however, no limitation is made to this configuration.

Further, as shown in the lateral side diagram (schematic diagram) of FIG. 6B, in a state where the wiper 36 is moved to the predetermined position (position of A in FIG. 3, as one example) and the pouring of the cleaning liquid is to be performed on the blade 34 of the wiper 36, the cleaning liquid guiding member 44 is arranged at a position where the distal end portion (upper end edge) 44*a* opposes and becomes parallel to the distal end portion (upper end edge) 34*a* of the blade 34 of the wiping unit 30, and the pouring of the cleaning liquid is to be performed on both front and back surfaces of the blade 34, that is, a position where the flow of the cleaning liquid flowing down from the cleaning liquid guiding member 44 is split by the distal end portion (upper end edge) 34*a* of the blade 34 and caused to flow on both of front and back surface sides of the blade 34.

According to the above configuration, as shown in the front diagram (schematic diagram) of FIG. 6A, an effect that the cleaning liquid that has been discharged from the cleaning liquid discharging pipe 42, by flowing on the angled surface 44*b*, flows down from the distal end portion (lower end edge) 44*a* in a state where the lateral width (width in the left and right direction of FIG. 6A) is widened compared to when it has been discharged is generated. That is, the cleaning liquid can be poured over a wider region (region wider in the left and right direction) with respect to the plate surface of the laterally elongate blade 34.

Further, the ink will adhere to both front and back surfaces of the blade 34 by the wiping operation, however, the pouring can be performed simultaneously to both front and back surfaces of the blade 34 by simply discharging the cleaning liquid, so that the adherent ink can be washed off. This can be realized while the cleaning liquid discharging pipe 42 and the cleaning liquid guiding member 44 are fixed, so that a complicated mechanism for changing a discharging direction of the cleaning liquid to both surface sides of the blade 34 does not need to be provided, whereby a device configuration can be simplified, and device cost reduction can be achieved.

Moreover, although the positioning for splitting the flow of the cleaning liquid needs to be performed highly accurately, in a case of configuring to pour the cleaning liquid on the blade 34 of the wiper 36 directly from the discharge port 42*a* of the cleaning liquid discharging pipe 42, a problem arises in that the positioning of the discharge port 42*a* for generating the desired flow split becomes very difficult. However, in the present embodiment, by the configuration having the cleaning liquid guiding member 44, an effect that the positioning for generating the desired flow split becomes very easy can be obtained.

Especially, in the present embodiment, the distal end portion (lower end edge) 44*a* of the cleaning liquid guiding member 44 includes a straight portion formed straight. Further, the distal end portion (upper end edge) 34*a* of the blade 34 of the wiping unit 30 includes a straight portion formed straight. Moreover, the straight portion (lower end edge 44*a*) of the cleaning liquid guiding member 44 and the straight portion (upper end edge 34*a*) of the blade 34 are arranged so as to be opposed and parallel to each other.

At this occasion, the distal end portion (lower end edge) 44*a* of the cleaning liquid guiding member 44 is preferably formed with a width by which the cleaning liquid flowed out from the outflow portion (discharge port) 42*a* spreads over substantially an entire region in a width direction of the blade 34 (left and right direction in FIG. 6A).

Further, the distal end portion (lower end edge) 44*a* of the cleaning liquid guiding member 44 and the distal end portion (upper end edge) 34*a* of the blade 34 are preferably arranged at an interval by which the cleaning liquid flowed out from the outflow portion (discharge port) 42 spreads over substantially the entire region in the width direction of the blade 34 (left and right direction in FIG. 6A).

According to these configurations, since it becomes possible to pour the cleaning liquid over substantially the entire region in the width direction (left and right direction in FIG. 6A) of the blade 34, the ink removal effect can be increased.

The cleaning liquid tray 46 is arranged below the discharge port of the cleaning liquid discharging pipe 42, the cleaning liquid guiding member 44, and the wiper 36 (including its moving range), and is a tray for collecting the cleaning liquid by which the pouring has been performed on the blade 34 of the wiper 36. It should be noted that a bottom surface of the cleaning liquid tray 46 is provided with a drainage hole 46*a*, and communicates with waste liquid tank (not shown).

Next, an operation of the inkjet recording device having the above configuration will be described, mainly focusing on the wiping operation by the wiping unit 30 and the cleaning operation by the cleaning unit 40.

In normal printing, the inkjet recording device 1 discharges the ink downward from the nozzles 23 of the inkjet head 20 while moving the carriage 14 (head unit 18) reciprocatingly right and left along the Y bar 12 with respect to the recording medium M on the platen 10, and performs the printing process on the recording medium M with a desired pattern. At this occasion, heating, ultraviolet ray irradiation, and the like are performed depending on the type of the ink, so that the ink adherent to the recording medium M comes to be in a desired hardened state.

When printing on a predetermined forward and backward width of the recording medium M is completed, the recording medium M is moved forward by sliding, and the operation to discharge the ink from the inkjet head 20 and harden the same while reciprocatingly moving the carriage 14 (head unit 18) right and left is repeated again. Accordingly, the desired letters or image patterns are printed on the entire print region of the recording medium M.

In the inkjet recording device 1, when the printing process is performed, the discharged ink may gradually adhere to the nozzle surface 24, especially around peripheral portions of the nozzles 23, and further, an ink droplet may be formed by the adherent ink merging with each other. Moreover, such an ink droplet gradually hardens, and in some cases may become viscous ink, for example in a gel form. Accordingly, if printing is continued in the state having the viscous ink and ink droplet and the like adhering to the nozzle surface 24 of the inkjet head 20, the ink droplet may drip onto the recording medium M, or cause clogging in the nozzles 23, whereby the print quality may be at the risk of being degraded, and therefore cleaning is performed periodically by performing wiping on the nozzle surface 24 of the inkjet head 20 using the wiping unit 30.

Cleaning by the above wiping is started, for example, by being triggered when an operator has judged that maintenance of the nozzle surface 24 of the inkjet head 20 is necessary and has operated an operation panel (not shown), or when a controller (not shown) determined that an operating time (printing time) since the previous maintenance has reached a predetermined time.

When cleaning is started by the above trigger, firstly, the carriage 14 (head unit 18) is moved to a position above the wiping unit 30 by a horizontally driving mechanism based on actuating signals from a controller, and a state is assumed in which the nozzle surface 24 of the inkjet head 20 and the wiping unit 30 are opposed each other.

Next, the wiper 36 is moved by the moving unit 38 of the wiping unit 30. More specifically, the blade 34 of the wiper 36 is slid with respect to the nozzle surface 24 (moved by sliding in a predetermined direction in a state of making contact), whereby the nozzle surface 24 is wiped and the ink adherent to the nozzle surface 24 is removed (see FIG. 5). It should be noted that, in the present embodiment, one wiping operation by the blade 34 is performed by a movement in one predetermined direction (an arrow direction in FIG. 5). However, no limitation is made hereto, and the configuration may be employed that wiping is performed by a reciprocating movement.

Accordingly, a clean state in which no ink droplet or viscous ink is adherent to the nozzle surface 24 and insides of the nozzles 23 of the inkjet head 20 can be assumed by performing wiping by the wiping unit 30, whereby ink discharge from the nozzles 23 is performed accurately, and further, unnecessary ink dripping can be prevented, so that high quality printing becomes possible.

On the other hand, the ink removed by performing the wiping operation as above adheres to the blade 34 of the wiper 36. The adherent ink gradually hardens, and in some cases may become viscous ink, for example in a gel form. Accordingly, if the wiping operation is performed continuously in the state where the removed ink or the viscous ink formed by hardening of the removed ink is adherent to the blade 34, the ink conversely adheres to the nozzle surface 24 of the inkjet head 20 upon wiping, and may drip onto the recording medium M, or become the cause of clogging and color mixing by entering the nozzles 23, to degrade the print quality.

To solve this problem, cleaning (washing) is performed periodically by pouring the cleaning liquid on the blade 34 of the wiping unit 30 by using the cleaning unit 40 of the present embodiment. It should be noted that a time during which pouring of the cleaning liquid is performed is set suitably depending on the type of the ink.

As one example, cleaning of the blade 34 by the cleaning unit 40 is performed for each wiping operation. As to the cleaning operation, more specifically, the wiper 36 is moved to the predetermined position (the position A in FIG. 3, as one example) by the moving unit 38 after the wiping operation has ended. When the position detection sensor (not shown) detects that the wiper 36 has moves to the predetermined position, the controller (not shown) outputs commands to cause the cleaning liquid to be discharged from the cleaning liquid discharging pipe 42.

Next, by flowing on the angled surface 44*b* of the cleaning liquid guiding member 44, the cleaning liquid discharged from the cleaning liquid discharging pipe 42 falls down from the distal end portion (lower end edge) 44*a* in the state where the liquid width (width of the cleaning liquid) is expanded in the longitudinal direction of the blade 34 (left and right direction in FIG. 6A) compared to when it has been discharged from the cleaning liquid discharging pipe 42, whereby the effect that the cleaning liquid is poured over a wider region in the left and right direction with respect to the plate surface of the blade 34 is obtained.

In addition to this, in the present embodiment, due to the configuration including the step portions 33 protruding in the front and back direction and extending in the left and right direction at positions that are lower than the distal end portion (upper end edge) 34*a* of the blade 34 by a predetermined length on both surface sides of the blade 34, the cleaning liquid that has been poured over the wider region in the left and right direction with respect to the plate surfaces of the blade 34 flows in the lateral direction (left and right direction in FIG. 6A) over the step portions 33 (that is, the upper surface 32*a* of the supporting member 32), and the effect that the cleaning liquid reaches even wider region can be achieved.

With the above acting synergistically, a prominent effect that cleaning is performed on the surfaces of the blade 34 not locally, but entirely can be achieved. Moreover, by flows of the cleaning liquid being generated from a center toward both the left direction and the right direction are generated, the wash-off effect can further be increased.

Further, as mentioned above, the cleaning liquid guiding member 44 is arranged at the position by which the flow of the cleaning liquid flowing down from the cleaning liquid guiding member 44 is split by the distal end portion (upper end edge) 34*a* of the blade 34 to flow on both front and back surfaces sides of the blade 34. Thus, cleaning of both front and back surfaces of the blade 34 can be performed at the same time just by discharging the cleaning liquid.

It should be noted that the cleaning liquid discharged from the cleaning liquid discharging pipe 42 and poured onto the blade 34 of the wiper 36 is collected by the cleaning liquid tray 46, and flows into the waste liquid tank (not shown) from the drainage hole 46*a*.

As described above, according to the inkjet recording device 1 disclosed herein, the wiping unit 30 and the cleaning unit 40 are provided to clean the blade 34 of the wiper 36 to which the ink has adhered, whereby clogging of the nozzles 23 of the inkjet head 20 and ink color mixing therein can be prevented to enable recording (printing) with high image quality.

Further, especially, the characteristic working effects as below are achieved by the present embodiment.

The inkjet recording device 1 disclosed herein is characteristic in including the wiping unit 30 that wipes off the ink by sliding the blade 34 on the nozzle surface 24 of the inkjet head 20; and the cleaning unit 40 that performs cleaning by pouring the cleaning liquid on the blade 34.

Further, the inkjet recording device 1 disclosed herein is characteristic in being an inkjet recording device in which liquid (ink) is supplied to the inkjet head 20 mounted on the carriage 14 that moves reciprocatingly in the main scanning direction (left and right direction in FIGS. 1 and 2), and the liquid (ink) is discharged from the nozzles 23 of the inkjet head 20 onto the opposing recording medium M while the carriage 14 is moving reciprocatingly in the main scanning direction, the inkjet recording device including: the wiping unit 30 including the blade 34 that wipes off the ink on the nozzle surface 24 of the inkjet head 20 by sliding its distal end portion 34*a* on the nozzle surface 24 from the lower side; and the cleaning unit 40 including the outflow portion (discharge port) 42*a* that allows the cleaning liquid to flow out to the distal end portion 34*a* side of the blade 34.

According to the inkjet recording device 1 disclosed herein, since the nozzle surface 24 of the inkjet head 20 can be wiped by the blade 34 of the wiping unit 30, the ink adherent to the nozzle surface 24 can be removed. Moreover, the blade 34 that has performed wiping can be cleaned by the cleaning unit 40, and the ink adherent to the blade 34 can be removed; thus, clogging of the nozzles 23 and ink color mixing in the inkjet head 20 can be prevented even in cases where wiping is performed continuously.

Further, in the present invention, the cleaning unit 40 is preferably arranged at one end portion in the main scanning direction (left and right direction in FIGS. 1 and 2), at the standby position for the inkjet head 20 to stand by.

Further, in the present invention, the cleaning unit 40 preferably allows the cleaning liquid to flow out to the distal end portion 34*a* side of the blade 34 in the state where the inkjet head 20 has moved to the standby position.

According to this, wiping of the nozzle surface 24 and cleaning of the blade 34 of the wiping unit 30 can be performed by using standby time of the inkjet head 20. Further, in view of the risk that an undesirable influence may occur in the printing process if wiping and cleaning are performed during the printing process, such an undesirable influence can be prevented.

Further, in the present invention, preferably the inkjet recording device further includes the storage portion (not shown) that stores the cleaning liquid; the flowing member (cleaning liquid discharging pipe) 42 having one end joined to the storage portion, including the outflow portion (discharge port) 42*a* at the other end, and configured to allow the cleaning liquid to flow through the inside thereof; and the controlling member (not shown) that controls the outflow of the cleaning liquid from the outflow portion (discharge port) 42*a* and the stoppage thereof. According to this, the cleaning liquid can be supplied from the storage portion provided in the inkjet recording device 1 to perform cleaning of the blade 34 of the wiping unit 30.

Further, in the present invention, the cleaning unit 40 preferably includes the cleaning liquid guiding member 44 between the distal end portion 34*a* of the blade 34 and the outflow portion (discharge port) 42*a*, the cleaning liquid guiding member 44 configured to expand the pouring region of the cleaning liquid and perform the positioning of the pouring position. According to this, it becomes possible to pour the cleaning liquid over a wider region in the longitudinal direction of the blade 34 with respect to the plate surface of the laterally elongate blade 34. Moreover, the pouring position, that is, the position where the cleaning liquid flows down can be set easily and highly accurately.

Further, in the present invention, preferably the cleaning liquid guiding member 44 has its distal end portion (lower end edge) 44*a* opposed to the distal end portion (upper end edge) 34*a* of the blade 34 with respect to the blade 34 at the predetermined position, and is arranged at the position that splits the flow of the cleaning liquid to both front and back surface sides of the blade 34. According to this, pouring can be performed on both of the front and back surfaces of the blade 34 just by discharging the cleaning liquid, and the adherent ink can be washed off. Thus, a complicated mechanism for changing a discharging direction of the cleaning liquid to both surface sides of the blade 34 does not need to be provided, whereby a device configuration can be simplified, and device cost reduction can be achieved.

Further, in the present invention, preferably the cleaning liquid guiding member 44 includes the straight portion (lower end edge 44*a*) of which distal end portion is formed straight, the blade 34 includes the straight portion (upper end edge 34*a*) of which distal end portion is formed straight, the straight portion (lower end edge 44*a*) of the cleaning liquid guiding member 44 and the straight portion (upper end edge 34*a*) of the blade 34 are arranged to be opposed and parallel to each other, and the cleaning liquid guiding member 44 has its distal end portion (lower end edge) 44*a* formed with the width by which the cleaning liquid flowed out from the outflow portion (discharge port) 42*a* spreads over substantially the entire region in the width direction of the blade 34.

Further, in the present invention, preferably the cleaning liquid guiding member 44 includes the straight portion (lower end edge 44*a*) of which distal end portion is formed straight, the blade 34 includes the straight portion (upper end edge 34*a*) of which distal end portion is formed straight, the straight portion (lower end edge 44*a*) of the cleaning liquid guiding member 44 and the straight portion (upper end edge 34*a*) of the blade 34 are arranged to be opposed and parallel to each other, and the distal end portions 44*a*, 34*a* of the cleaning liquid guiding member 44 and the blade 34 are arranged at the interval by which the cleaning liquid flowed out from the outflow portion (discharge port) 42*a* spreads over substantially the entire region in the width direction of the blade 34.

According to these, since it becomes possible to pour the cleaning liquid over substantially the entire region in the width direction (longitudinal direction) of the blade 34 for cleaning, the ink removal effect can be increased.

Further, in the present invention, the cleaning liquid guiding member 44 is preferably supported by the supporting member 2 by which the wiping unit 30 is supported. According to this, since the cleaning liquid guiding member 44 and the wiping unit 30 (especially the blade 34) are supported by the same member (supporting member 2), the positional accuracy of arrangements of both the cleaning liquid guiding member 44 and the blade 34 can be improved.

Further, in the present invention, the wiping unit 30 preferably includes step portions 33 at both surface sides of the blade 34 at the positions that are lower than the distal end portion (upper end edge) 34*a* of the blade 34 by the predetermined length. According to this, the cleaning liquid that has been poured onto the blade 34 flows in left and right directions on the step portions 33 and reaches the wider region in the longitudinal direction, whereby the effect that the surface of the blade 34 is cleaned over a wide region can be obtained. Moreover, since flows of the cleaning liquid are generated from a center toward both the left direction and the right direction, the cleaning effect can further be increased.

It should be noted that the present invention is not limited to the embodiments described above, and it goes without saying that it can be modified in various ways within the scope that does not go beyond the present invention.

The invention claimed is:

1. An inkjet recording device, comprising:

a wiping unit, which includes a blade, and the wiping unit wipes off ink by sliding a distal end portion of the blade on a nozzle surface of an inkjet head; and a cleaning unit, which includes an outflow portion for discharging a cleaning liquid, and the outflow portion is disposed at an upper side in a height direction higher than the distal end portion of the blade, and the outflow portion has a discharge port with a width narrower than a width of the blade, and the cleaning liquid is poured from the discharge port toward a portion of a width direction of the distal end portion of the blade, and among plate surfaces of the blade, at least a plate surface of the blade adhered by the ink wiped off from the nozzle surface is cleaned by pouring the cleaning liquid on the blade, wherein the wiping unit includes a supporting member which supports the plate surface of the blade;

the supporting member includes step portions, and the step portions have a predetermined length and are disposed at a lower side than the distal end portion of the blade in the height direction, after the distal end portion of the blade is poured by the cleaning liquid, the cleaning liquid flows from the distal end portion of the blade toward the lower side in the height direction, and the step portions spread the cleaning liquid in a width direction of the plate surface of the blade;

the step portions are disposed in a position in the height direction that the cleaning liquid is capable of being spread toward a wide region of the plate surface of the blade other than the portion of the width direction of the distal end portion of the blade.

2. The inkjet recording device according to claim 1, wherein the cleaning unit includes a cleaning liquid guiding member, and the cleaning liquid guiding member is configured to expand a pouring region of the cleaning liquid, and perform positioning of a pouring position.

3. The inkjet recording device according to claim 2, wherein the cleaning liquid guiding member has its distal end portion oppose the distal end portion of the blade with respect to the blade at a predetermined position, and is arranged at a position that splits a flow of the cleaning liquid to both front and back surface sides of the blade.

4. The inkjet recording device according to claim 2, wherein the cleaning liquid guiding member includes a straight portion of which distal end portion is formed straight, the blade includes a straight portion of which distal end portion is formed straight, the straight portion of the cleaning liquid guiding member and the straight portion of the blade are arranged to be opposed and parallel to each other, and the cleaning liquid guiding member has its distal end portion formed with a width by which the cleaning liquid flowed out from the outflow portion spreads over substantially an entire region in a width direction of the blade.

5. The inkjet recording device according to claim 2, wherein the cleaning liquid guiding member includes a straight portion of which distal end portion is formed straight, the blade includes a straight portion of which distal end portion is formed straight, the straight portion of the cleaning liquid guiding member and the straight portion of the blade are arranged to be opposed and parallel to each other, and the distal end portions of the cleaning liquid guiding member and the blade are arranged at an interval by which the cleaning liquid flowed out from the outflow portion spreads over substantially an entire region in a width direction of the blade.

6. The inkjet recording device according to claim 2, wherein the cleaning liquid guiding member is supported by the supporting member by which the wiping unit is supported.

7. The inkjet recording device according to claim 1, wherein the step portions are disposed at both surface sides of the blade at positions that are lower than the distal end portion of the blade by the predetermined length.

8. An inkjet recording device in which liquid is supplied to an inkjet head mounted on a carriage that moves reciprocatingly in a main scanning direction, and the liquid is discharged from a nozzle of the inkjet head onto an opposing recording medium while the carriage is moving reciprocatingly in the main scanning direction, the inkjet recording device comprising:

a wiping unit, including a blade that wipes off ink on a nozzle surface of the inkjet head by sliding a distal end portion of the blade on the nozzle surface from a lower side; and a cleaning unit, including an outflow portion that allows a cleaning liquid to flow out to a distal end portion side of the blade, wherein the outflow portion is disposed at an upper side in a height direction higher than the distal end portion of the blade, and the outflow portion has a discharge port with a width narrower than a width of the blade, and the cleaning liquid is poured from the discharge port toward a portion of a width direction of the distal end portion of the blade, and among plate surfaces of the blade, at least a plate surface of the blade adhered by the ink wiped off from the nozzle surface is cleaned by pouring the cleaning liquid on the blade, wherein the wiping unit includes a supporting member which supports the plate surface of the blade;

the supporting member includes step portions, and the step portions have a predetermined length and are disposed at a lower side than the distal end portion of the blade in the height direction, after the distal end portion of the blade is poured by the cleaning liquid, the cleaning liquid flows from the distal end portion of the blade toward the lower side in the height direction, and the step portions spread the cleaning liquid in a width direction of the plate surface of the blade;

the step portions are disposed in a position in the height direction that the cleaning liquid is capable of being spread toward a wide region of the plate surface of the blade other than the portion of the width direction of the distal end portion of the blade.

9. The inkjet recording device according to claim 8, wherein the cleaning unit is arranged at one end portion in the main scanning direction, at a standby position for the inkjet head to stand by.

10. The inkjet recording device according to claim 9, wherein the cleaning unit allows the cleaning liquid to flow out to the distal end portion side of the blade in a state where the inkjet head has moved to the standby position.

11. The inkjet recording device according to claim 8, further comprising:

a storage portion that stores the cleaning liquid;

a flowing member, having one end joined to the storage portion, and the flowing member including the outflow portion at the other end, and the flowing member is configured to allow the cleaning liquid to flow through an inside thereof.

12. The inkjet recording device according to claim 8, wherein the cleaning unit includes a cleaning liquid guiding member, and the cleaning liquid guiding member is configured to expand a pouring region of the cleaning liquid, and perform positioning of a pouring position.

13. The inkjet recording device according to claim 12, wherein the cleaning liquid guiding member has its distal end portion oppose the distal end portion of the blade with respect to the blade at a predetermined position, and is arranged at a position that splits a flow of the cleaning liquid to both front and back surface sides of the blade.

14. The inkjet recording device according to claim 12, wherein the cleaning liquid guiding member includes a straight portion of which distal end portion is formed straight, the blade includes a straight portion of which distal end portion is formed straight, the straight portion of the cleaning liquid guiding member and the straight portion of the blade are arranged to be opposed and parallel to each other, and the cleaning liquid guiding member has its distal end portion formed with a width by which the cleaning liquid flowed out from the outflow portion spreads over substantially an entire region in a width direction of the blade.

15. The inkjet recording device according to claim 12, wherein the cleaning liquid guiding member includes a straight portion of which distal end portion is formed straight, the blade includes a straight portion of which distal end portion is formed straight, the straight portion of the cleaning liquid guiding member and the straight portion of the blade are arranged to be opposed and parallel to each other, and the distal end portions of the cleaning liquid guiding member and the blade are arranged at an interval by which the cleaning liquid flowed out from the outflow portion spreads over substantially an entire region in a width direction of the blade.

16. The inkjet recording device according to claim 12, wherein the cleaning liquid guiding member is supported by the supporting member by which the wiping unit is supported.

* * * * *